United States Patent [19]

Simmons

[11] Patent Number: 4,927,993

[45] Date of Patent: May 22, 1990

[54] LOCKING CYLINDER HEATING

[76] Inventor: Ray A. Simmons, P.O. Box 1193, Muskogee, Okla. 74402-1193

[21] Appl. No.: 277,977

[22] Filed: Nov. 30, 1988

[51] Int. Cl.[5] ..... E05B 17/00; H05B 3/00

[52] U.S. Cl. ..... 219/201; 70/431; 219/202; 219/535; 219/536; 219/552

[58] Field of Search ..... 219/301, 201, 202, 535, 219/536, 542, 552, 200; 70/431; 138/33

[56] References Cited

U.S. PATENT DOCUMENTS

| | | | |
|---|---|---|---|
| 1,140,864 | 5/1915 | Aubrey | 219/535 |
| 1,423,742 | 7/1922 | Silverman | 138/33 X |
| 1,489,444 | 4/1924 | Kestler | 138/33 |
| 1,770,642 | 7/1930 | Gelino | 219/552 X |
| 2,382,512 | 8/1945 | Simon | 138/33 |
| 2,390,475 | 12/1945 | Thomas | 219/535 |
| 2,518,863 | 8/1950 | Camden et al. | 219/301 X |
| 2,538,872 | 1/1951 | Jones | 70/431 |
| 2,774,855 | 12/1956 | Simmons | 219/201 X |
| 3,192,359 | 6/1965 | Swindall | 219/201 |
| 4,110,603 | 8/1978 | Peterson et al. | 219/301 X |
| 4,442,341 | 4/1984 | Lesquereux et al. | 219/536 X |

FOREIGN PATENT DOCUMENTS

| | | | |
|---|---|---|---|
| 227483 | 9/1985 | German Democratic Rep. | 219/201 |

*Primary Examiner*—Anthony Bartis

[57] ABSTRACT

A device is disclosed for preventing freezing of locking cylinders, which includes a heat conductive body member with an incandescent bulb removably mounted within an open-top internal recess. A temperature activated switch provides power to illuminate the bulb and thus heat the locking cylinder when the temperature reaches a predetermined limit, such as 0° C. (32° F.). A heat conductive spring thermally connected at its ends to the body extends around the locking cylinder to hold the body member against an underside of the locking cylinder whereby radiant and convective heat from the lamp may pass through the open top recess to heat the cylinder.

4 Claims, 1 Drawing Sheet

LOCKING CYLINDER HEATING

BACKGROUND OF THE INVENTION

1. Field of the Invention

The present invention relates to devices for preventing locking cylinders from freezing and, more particularly, to such devices that are easily added to existing installations of such locking cylinders.

2. Description of the Prior Art

Numerous devices have been developed to heat locking cylinders after they have become frozen, such as U.S. Pat. Nos. 3,192,359; 4,247,753; and 4,303,825. Since the thawing process can take time that can cause problems when one is in a hurry, a device to prevent a locking cylinder from freezing is preferable.

Typical devices to prevent locking cylinders from freezing are disclosed in U.S. Pat. Nos. 3,662,149 and 4,442,341 wherein PTC heating elements are embedded within heat-conductive, electrically insulative material and provide conductive heat to a rear portion or an underside of a locking cylinder. None of these devices provide conductive heat around a locking cylinder, convective heat, or radiant heat of any form, and do not include easily replaceable heating elements. These features can be beneficial to use. There is a need for a device that prevents locking cylinders from freezing that includes these features.

SUMMARY OF THE INVENTION

The present invention has been developed to overcome the foregoing deficiencies and meet the above described needs. Specifically, the present invention comprises a heat conductive body member with an incadescent bulb mounted within a box-like recess therein. A heat conductive spring extends around a locking cylinder and holds the bulb in spaced relation to the underside of the locking cylinder. A temperature activated switch is utilized to provide electrical current to illuminate the bulb when the temperature reaches 0° C. (32° F.). By illuminating the bulb, convective, conductive and radiant heat are directed at the locking cylinder to prevent it from freezing.

DETAILED DESCRIPTION OF THE PREFERRED EMBODIMENTS

Figure 2:
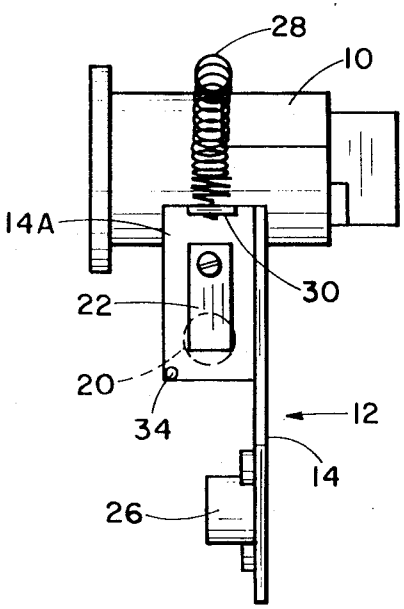
FIG. 2 is a left side elevational view of a locking cylinder having a heating device, embodying the present invention, attached thereto.
Figure 1:
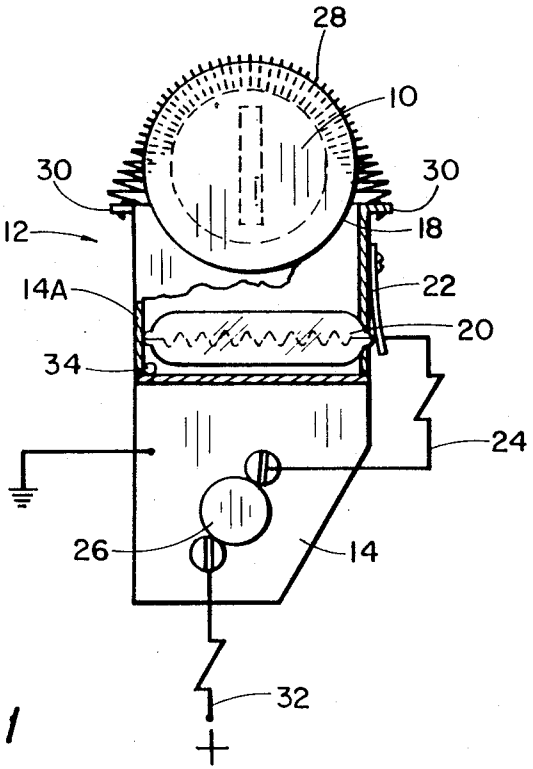
FIG. 1 is a front elevational view of a locking cylinder having a heating device, embodying the present invention, attached thereto.

As shown in FIGS. 1 and 2, a locking cylinder 10 is to be heated by a heating device 12, which will be described in more detail below. The locking cylinder 10 can be the type used in motor vehicles of all types and also the type used within doors of buildings. The heating device 12 comprises a generally planar body member 14, which includes a box-like portion 14A with an open top/closed bottom forming a recess 18. The body member 14 is formed from heat conductive, electrically conductive material, such as aluminum or steel, and includes arcuate box-like portion 14A in an upper portion of the box-like portion 14A for receiving a lower portion of the locking cylinder 10 thereinto. Within the box-like portion 14A a small incadescent bulb 20 can be mounted so that a first contact extends through an opening (not shown) and a second contact abuts against the interior surface of one end of the box-like portion 14A to make electrical contact with the box-like portion 14A. A spring metal finger member 22 is electrically insulated from the body member 14 and extends across the opening therein to make electrical contact with the first contact of the bulb 20. The bulb 20 can be of any size or configuration desirable which generates radiant heat energy, conductive heat energy and/or convective heat energy. To ensure that power consumption is low, an automotive 12 volt DC 0.15 amp interior/accessory bulb has been found to be suitable.

The first contact of the bulb 20 and the finger member 22 are connected by a wire 24 to a first contact of a temperature actuated switch 26, which has a second contact thereof connected to a source of electrical power, such as a vehicle battery. In the situation that the heating device 12 is to be added within an automobile door, the body member 14 itself is grounded because it is either screwed or riveted to a mount within the door or it is grounded because it is placed into contact with the grounded door locking cylinder 10. To ensure that the heating device 12 is held against the locking cylinder 10, a heat conductive spring 28 is removably attached around the locking cylinder 10 and each end thereof is connected to studs 30 which extend from an upper portion of the body member 14 or the box-like portion 14A.

In the operation of the present invention, a wire 32 is connected between a source of electrical current and a second contact of the temperature activated switch 26. A suitable bulb 20 is mounted within the box-like portion 14A and the spring 28 is extended around the locking cylinder 10. The switch 26 is a normally open contact type so that as long as the temperature is above a predetermined value, such as 0° C. (32° F.) the bulb 20 will not be illuminated, i.e., there will be no current flow. When the temperature drops below the predetermined value the switch's contact closes thereby illuminating the bulb 20. The illuminated bulb 20 generates radiant heat energy, convective heat energy (by heating the air within the box-like recess 14A) and/or conductive heat (by heating the body member 14 and the spring 28). The benefit of this type of heating arrangement is that multiple heating processes are used and, because of the heat conductive spring 28, the entire locking cylinder 10—not just its underside—is heated. During the heating process, if any water vapor condenses or ice melts the resulting water can flow out of one or more drain openings 34 in the lower portion of the box-like recess 16. When the temperature rises above a predetermined level, such as about 38° F.–45° F., the switch 26 opens and the bulb 20 ceases from being illuminated.

Wherein the present invention has been described in particular relation to the drawings attached hereto, it should be understood that other and further modifications, apart from those shown or suggested herein, may be made within the spirit and scope of the present invention.

What is claimed is:

1. A device for preventing freezing or locking cylinders and adapted to be removably connected thereto, comprising:

an electrically and thermally conductive body member adapted to be electrically grounded, the body member comprising an upper box-like portion adapted to be received against the locking cylinder and a lower portion, the box-like portion including an internal recess with an top opening to permit passage of radiant and convected heat therefrom;

an incandescent bulb removably mounted within the internal recess with a first contact electrically isolated and a second contact electrically connected to the body member;

a temperature activated means mounted to the lower portion of the body member and electrically connected between a power source and the first contact of the bulb to illuminate the bulb at a predetermined temperature; and a removable heat conductive spring thermally connectable at each end thereof to opposed upper ends of the body member and adapted to extend around the locking cylinder to hold the body member thereagainst and conduct heat to the locking cylinder.

2. A device of claim 1 wherein the body member includes openings in a lower portion of the box-like portion to permit any moisture present to drain.

3. A device of claim 1 wherein a spring metal contact is mounted to an exterior surface of the body member in electrically isolated relation thereto, the first contact of the bulb extending outwardly through an opening in the body member into contact with the spring metal contact to form part of an electrical circuit between the temperature activated means and the first contact.

4. A device of claim 1 wherein the temperature activated means comprises a temperature responsive electrical switch.

* * * * *